US011542903B2

(12) United States Patent
Kawano et al.

(10) Patent No.: US 11,542,903 B2
(45) Date of Patent: Jan. 3, 2023

(54) HIGH-PRESSURE FUEL SUPPLY PUMP PROVIDED WITH ELECTROMAGNETIC INTAKE VALVE

(71) Applicant: HITACHI AUTOMOTIVE SYSTEMS, LTD., Hitachinaka (JP)

(72) Inventors: Tatsuo Kawano, Hitachinaka (JP); Kenichiro Tokuo, Hitachinaka (JP); Satoshi Usui, Hitachinaka (JP); Masamichi Yagai, Hitachinaka (JP); Kazuaki Tokumaru, Hitachinaka (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 0 days.

(21) Appl. No.: 16/468,625

(22) PCT Filed: Nov. 16, 2017

(86) PCT No.: PCT/JP2017/041203
§ 371 (c)(1),
(2) Date: Jun. 11, 2019

(87) PCT Pub. No.: WO2018/123323
PCT Pub. Date: Jul. 5, 2018

(65) Prior Publication Data

US 2020/0080526 A1 Mar. 12, 2020

(30) Foreign Application Priority Data

Dec. 28, 2016 (JP) ..... JP2016-254654

(51) Int. Cl.
*F02M 59/46* (2006.01)
*F02M 59/36* (2006.01)
(Continued)

(52) U.S. Cl.
CPC ..... *F02M 59/466* (2013.01); *F02M 59/366* (2013.01); *F02D 41/3845* (2013.01);
(Continued)

(58) Field of Classification Search
CPC ..... F02D 41/3845; F02M 2200/04; F02M 2200/315; F02M 2200/502; F02M 59/025;
(Continued)

(56) References Cited

U.S. PATENT DOCUMENTS

| | | | | |
|---|---|---|---|---|
| 9,267,496 | B2 | 2/2016 | Kawano et al. | |
| 9,920,727 | B2 | 3/2018 | Kawano et al. | |
| 10,294,907 | B2 * | 5/2019 | Hashida | F02M 59/368 |
| 2012/0090708 | A1 * | 4/2012 | Usui | F02M 37/043 137/565.16 |
| 2012/0301340 | A1 * | 11/2012 | Aritomi | F02M 59/466 417/505 |

(Continued)

FOREIGN PATENT DOCUMENTS

| | | | |
|---|---|---|---|
| JP | 2012-082849 | * | 4/2012 |
| JP | 2012-082849 | A | 4/2012 |

(Continued)

OTHER PUBLICATIONS

International Search Report with English translation and Written Opinion issued in corresponding application No. PCT/JP2017/041203 dated Mar. 6, 2018.

*Primary Examiner* — Phutthiwat Wongwian
*Assistant Examiner* — Diem T Tran
(74) *Attorney, Agent, or Firm* — Foley & Lardner LLP

(57) ABSTRACT

An object of the present invention is to prevent generation of wear at a rod collision portion in an electromagnetic intake valve of a high-pressure fuel supply pump by reducing inclinations of the intake valve and a rod.
A structure of the electromagnetic intake valve of the high-pressure fuel supply pump is configured as follows. A
(Continued)

seat portion of an intake valve and a guide portion of a rod are configured as an integral part, and further, a rod guide is made to have a sufficiently long length so that it is possible to perform guide at one portion. Further, the intake valve seat portion and a surface where the rod collides with the intake valve are formed on the same plane.

16 Claims, 5 Drawing Sheets

(51) Int. Cl.
*F02D 41/38* (2006.01)
*F02M 59/02* (2006.01)
*F02M 63/02* (2006.01)

(52) U.S. Cl.
CPC ..... *F02M 59/025* (2013.01); *F02M 63/0225* (2013.01); *F02M 2200/04* (2013.01); *F02M 2200/315* (2013.01); *F02M 2200/502* (2013.01)

(58) Field of Classification Search
CPC ..... F02M 59/34; F02M 59/36; F02M 59/366; F02M 59/466; F02M 63/0225
See application file for complete search history.

(56) References Cited

U.S. PATENT DOCUMENTS

2012/0312278 A1* 12/2012 Usui ..... F02M 59/102 123/446
2013/0052064 A1* 2/2013 Oikawa ..... F04B 11/0016 417/540
2013/0214066 A1* 8/2013 Suzuki ..... F02M 51/0653 239/585.5
2014/0099215 A1 4/2014 Kawano et al.
2015/0017039 A1* 1/2015 Usui ..... F02M 51/04 417/505
2016/0160826 A1 6/2016 Kawano et al.
2018/0163683 A1 6/2018 Kawano et al.

FOREIGN PATENT DOCUMENTS

JP 2012-251447 A 12/2012
JP 2015-218675 A 12/2015
JP 2016-094913 A 5/2016
JP 2016-142143 A 8/2016

* cited by examiner

HIGH-PRESSURE FUEL SUPPLY PUMP PROVIDED WITH ELECTROMAGNETIC INTAKE VALVE

TECHNICAL FIELD

The present invention relates to a high-pressure fuel supply pump that supplies high-pressure fuel to a fuel injection valve which injects fuel directly into a cylinder of an internal combustion engine, and more particularly to a high-pressure fuel supply pump provided with an electromagnetic intake valve which adjusts the amount of fuel to be discharged.

BACKGROUND ART

In a high-pressure fuel supply pump equipped with a conventional electromagnetic intake valve described in the PTL 1 or PTL 2 listed below, the electromagnetic intake valve in which the intake valve is held in a valve-opening direction by a rod by a biasing force of a spring in a state where an electromagnetic coil is not energized is described. When the electromagnetic coil is energized, the intake valve is closed by a magnetic attractive force generated in the electromagnetic intake valve. Accordingly, it is possible to control movement of the intake valve to open and be closed depending on whether or not the electromagnetic coil is energized, whereby the supply amount of high-pressure fuel can be controlled.

In addition, it is described that the conventional electromagnetic intake valve described in PTL 1 is constituted by an intake valve made of a flat plate, a seat member that seats the intake valve, a rod that holds the intake valve in a valve-opening direction by a biasing force of a spring, and a member that guides the rod. It is possible to stabilize an operation of the intake valve by guiding the rod in this manner and to accurately control a flow rate.

In addition, it is described that the conventional electromagnetic intake valve described in JP 2012-251447 A is constituted by a cup-type intake valve, a seat member having both functions of a seat for the intake valve and a guide for a rod, and a rod that holds the intake valve in a valve-opening direction by a biasing force of a spring. Even with such a configuration, it is possible to stabilize the operation of the intake valve and to accurately control a flow rate.

CITATION LIST

Patent Literature

PTL 1: JP 2016-094913 A
PTL 2: JP 2012-251447 A

SUMMARY OF INVENTION

Technical Problem

In the electromagnetic intake valves of the conventional high-pressure fuel supply pumps described in the above-described PTLs 1 and 2, however, an intake valve seat portion and a guide portion of the rod are formed as separate components. In addition, the intake valve seat portion and a rod collision surface are formed by different planes in PTL 2. In this case, an inclination when the intake valve and the rod collide increases. When the intake valve and the rod collide with each other in the inclined state, the rod collides with the intake valve in a corner contact state, and thus, there is a problem that stress concentration occurs to cause wear.

An object of the present invention is to prevent generation of wear at a rod collision portion in an electromagnetic intake valve of a high-pressure fuel supply pump by reducing inclinations of the intake valve and a rod.

Solution to Problem

In order to achieve the above object, a high-pressure fuel supply pump of the present invention includes: an intake valve 30 that has a planar portion 30*d*; a rod portion 35 that biases the planar portion 30*d* in a valve-opening direction; and a seat member 31 that is formed at a position parallel to the planar portion 30*d* and has an intake valve seat 31*a* on which the intake valve 30 is seated. The seat member 31 is formed with a guide which guides the rod portion 35 on the side opposite to the intake valve 30 with respect to a contact position between the rod portion 35 and the planar portion 30*d*.

Advantageous Effects of Invention

According to the present invention configured in this manner, it is possible to reduce the inclination when the rod and the intake valve collide with each other and to prevent generation of the wear at the rod collision portion.

DESCRIPTION OF EMBODIMENTS

Figure 1:
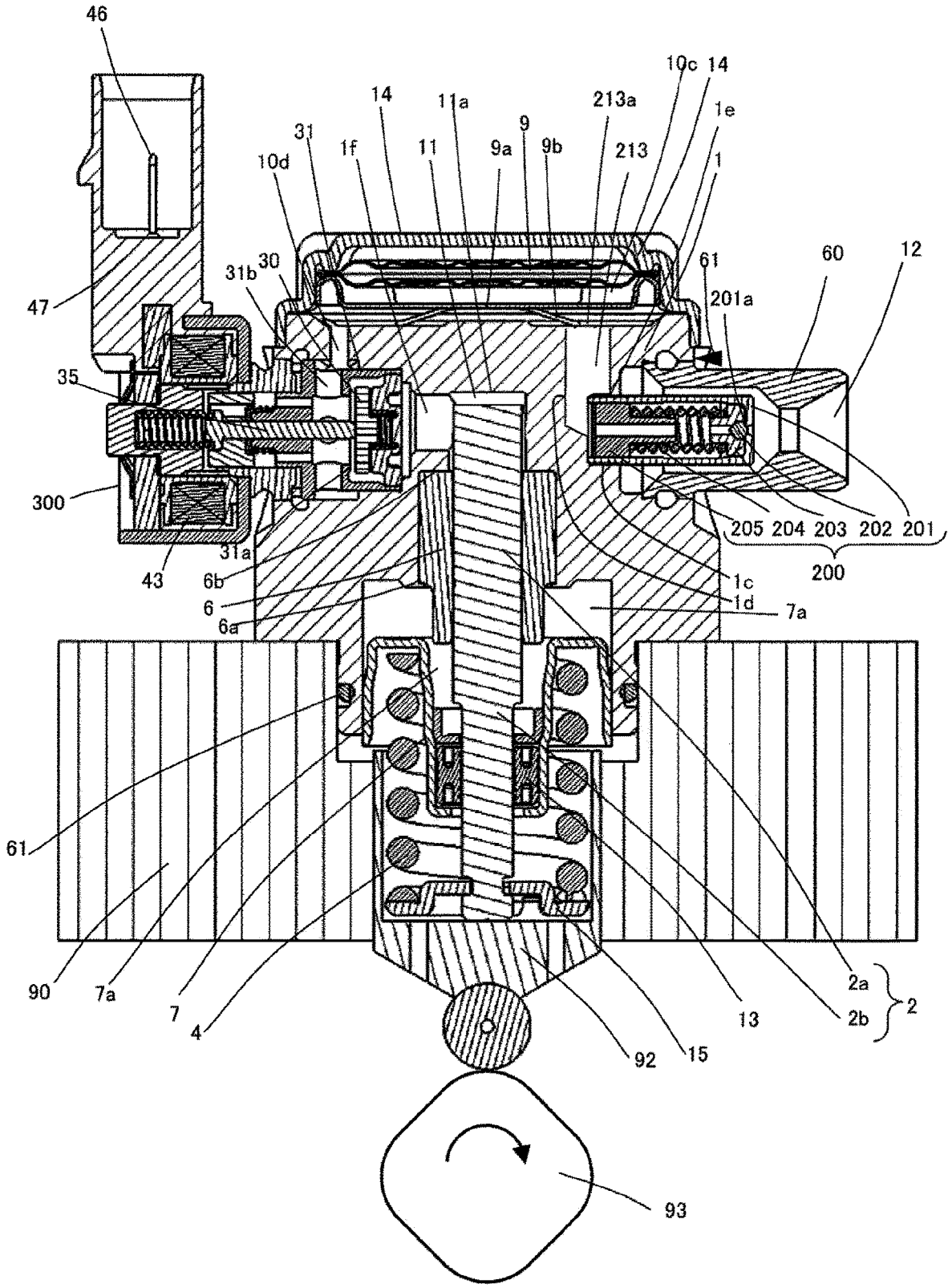
FIG. 1 is a vertical cross-sectional view of a high-pressure fuel supply pump according to a first embodiment of the present invention.

Hereinafter, the present invention will be described in detail with reference to embodiments illustrated in the drawings.

First Embodiment

Figure 5:
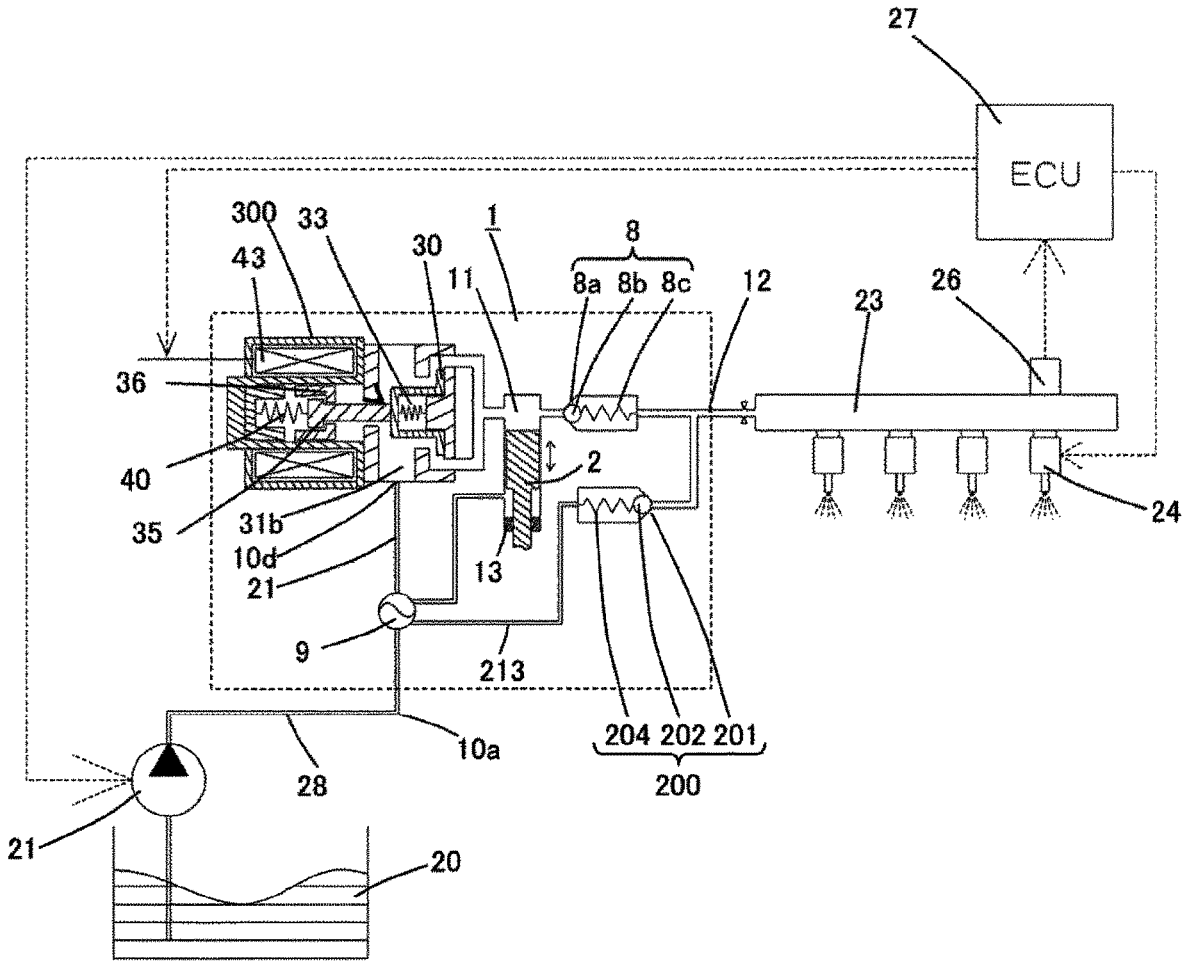
FIG. 5 illustrates a configuration diagram of an engine system to which the high-pressure fuel supply pump according to the first embodiment of the present invention is applied.

First, a first embodiment of the present invention will be described in detail with reference to the drawings. FIG. 5 illustrates an overall configuration diagram of an engine system. A portion surrounded by a broken line indicates a main body of a high-pressure fuel supply pump (hereinafter referred to as the high-pressure fuel supply pump), and mechanisms and components illustrated in this broken line are integrally incorporated in a pump body 1.

Fuel in a fuel tank 20 is pumped up by a feed pump 21 based on a signal from an engine control unit 27 (hereinafter referred to as the ECU). This fuel is pressurized to an appropriate feed pressure and sent to a low-pressure fuel intake port 10*a* of the high-pressure fuel supply pump through a suction pipe 28.

The fuel having passed through an intake joint 51 from the low-pressure fuel intake port 10*a* reaches an intake port 31*b* of an electromagnetic intake valve mechanism 300 forming a capacity variable mechanism via a pressure pulsation reduction mechanism 9 and an intake passage 10*b*.

The fuel flowing into the electromagnetic intake valve mechanism 300 passes through the intake port to be opened and closed by an intake valve 30 and flows into a pressurizing chamber 11. A cam mechanism 93 of the engine applies motive power for a reciprocating motion to a plunger 2. Due to the reciprocating motion of the plunger 2, fuel is sucked from the intake valve 30 in a descending step of the plunger 2, and the fuel is pressurized in an ascending step thereof. Fuel is pumped through a discharge valve mechanism 8 to a common rail 23 to which a pressure sensor 26 is mounted. An injector 24 injects fuel to the engine based on a signal from the ECU 27. The present embodiment relates to a high-pressure fuel supply pump which is applied to a so-called direct injection engine system in which the injector 24 injects fuel directly into a cylinder barrel of the engine.

The high-pressure fuel supply pump discharges a fuel flow rate of a desired supplied fuel based on the signal from the ECU 27 to the electromagnetic intake valve mechanism 300.

Figure 2:
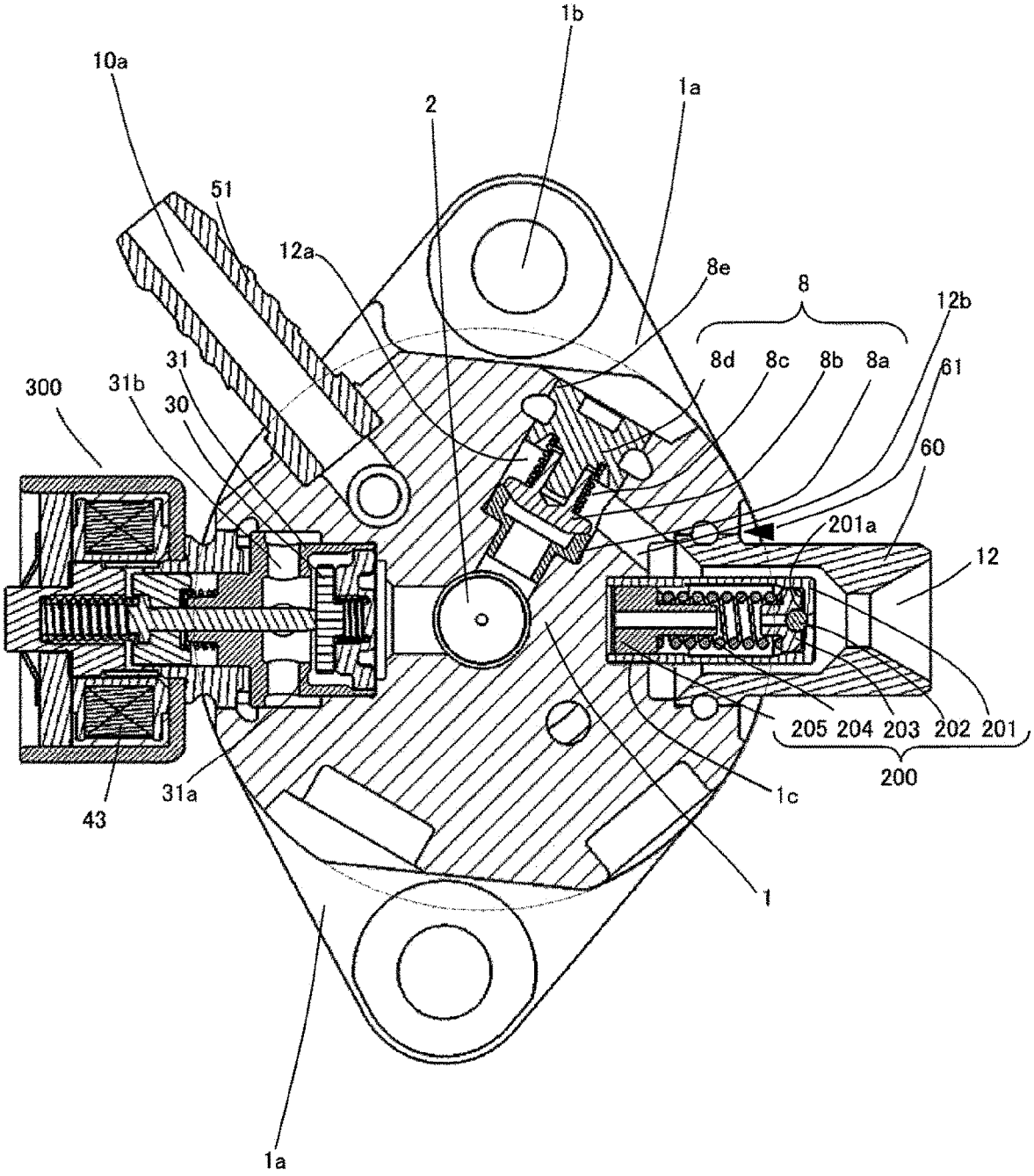
FIG. 2 is a horizontal cross-sectional view of the high-pressure fuel supply pump according to the first embodiment of the present invention, as viewed from above.
Figure 3:
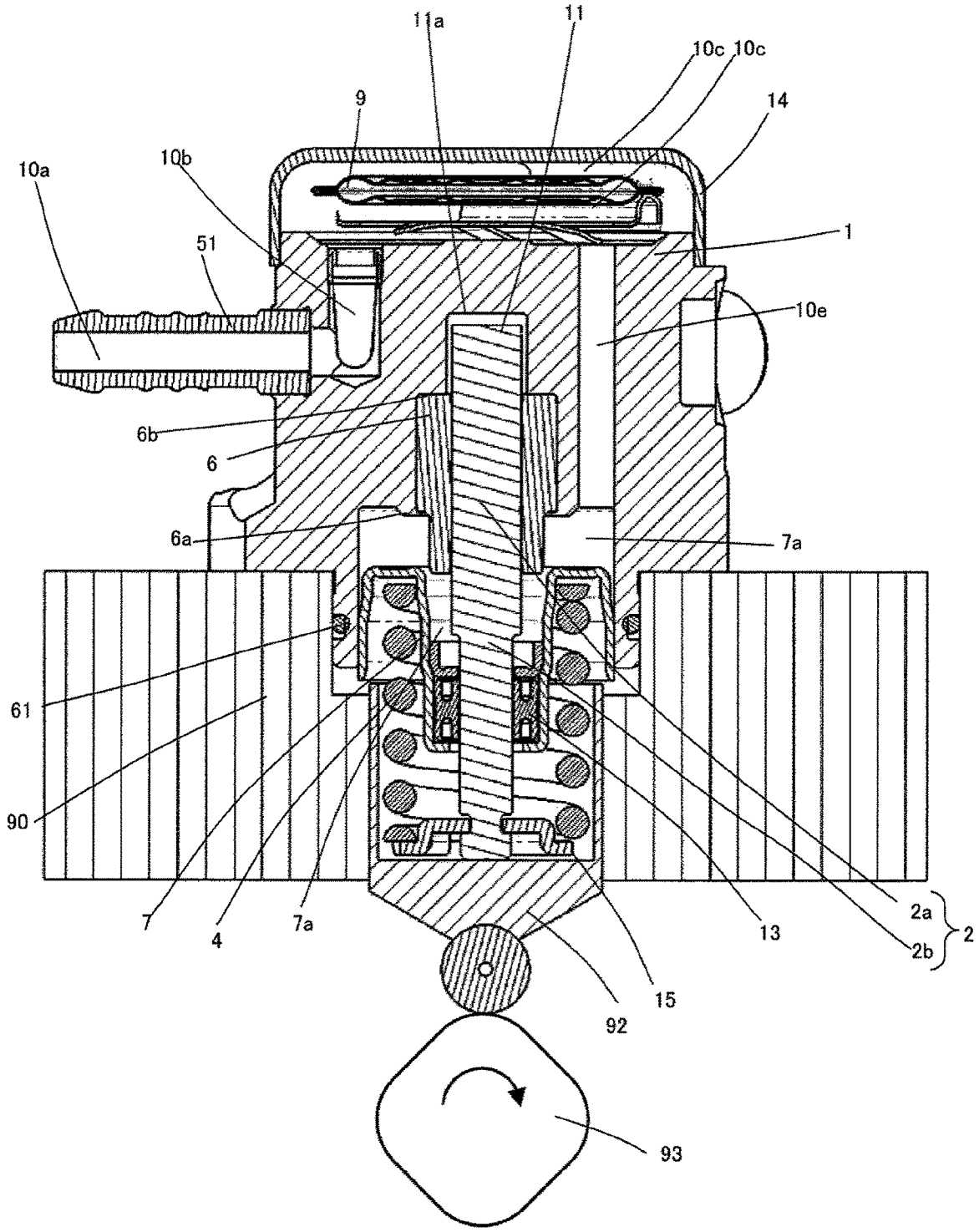
FIG. 3 is a vertical cross-sectional view of the high-pressure fuel supply pump according to the first embodiment of the present invention, as viewed from a direction different from the direction in FIG. 1.
Figure 4:
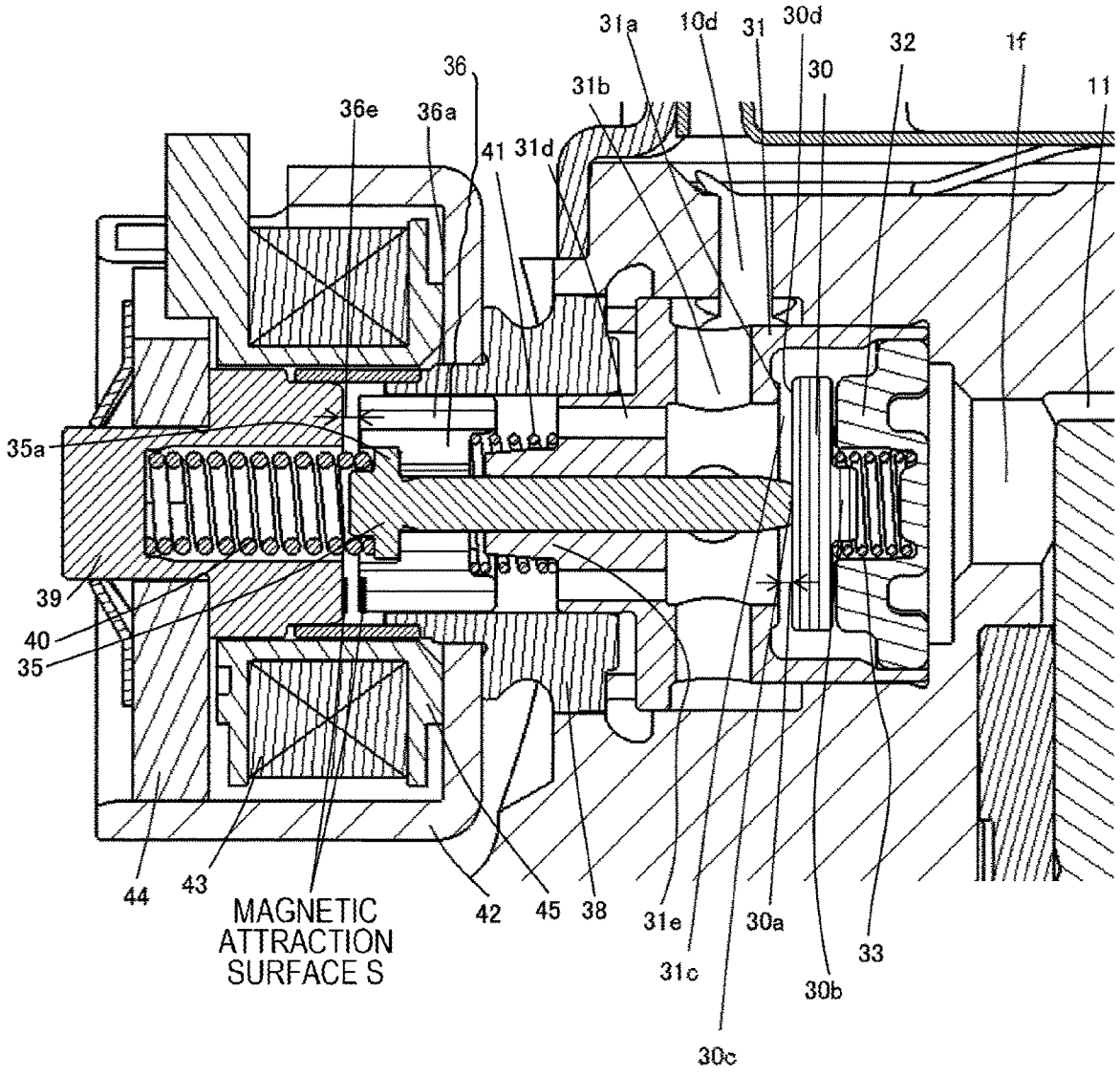
FIG. 4 is an enlarged vertical cross-sectional view of an electromagnetic intake valve mechanism of the high-pressure fuel supply pump according to the first embodiment of the present invention, which illustrates a state where the electromagnetic intake valve mechanism is in an open valve state.

FIG. 1 is a vertical cross-sectional view of the high-pressure fuel supply pump of the present embodiment, and FIG. 2 is a horizontal cross-sectional view of the high-pressure fuel supply pump, as viewed from above. In addition, FIG. 3 is a vertical cross-sectional view of the high-pressure fuel supply pump as viewed from a direction different from the direction in FIG. 1. FIG. 4 is an enlarged view of the electromagnetic intake valve mechanism 300.

As illustrated in FIGS. 1 and 3, the high-pressure fuel supply pump of the present embodiment is fixed in close contact with a high-pressure fuel supply pump mounting portion 90 of an internal combustion engine. More specifically, screw holes 1*b* are formed in a mounting flange 1*a* provided in the pump body 1 of FIG. 2, and with a plurality of bolts inserted into the screw holes, the mounting flange 1*a* is brought into close contact with and fixed to the high-pressure fuel supply pump mounting portion 90 of the internal combustion engine.

In order for seal between the high-pressure fuel supply pump mounting portion 90 and the pump body 1, an O-ring 61 is fitted into the pump body 1 to prevent engine oil from leaking to the outside.

A cylinder 6, which guides the reciprocating motion of the plunger 2 and forms the pressurizing chamber 11 together with the pump body 1, is attached to the pump body 1. That is, the plunger 2 reciprocates inside the cylinder to change the volume of the pressurizing chamber. In addition, the electromagnetic intake valve mechanism 300 configured to supply fuel to the pressurizing chamber 11 and the discharge valve mechanism 8 configured to discharge the fuel from the pressurizing chamber 11 to a discharge passage are provided.

The cylinder 6 is press-fitted into the pump body 1 on an outer circumferential side thereof. Further, the body is deformed toward an inner circumferential side at a fixing portion 6*a* to push the cylinder in an upper direction in the drawing, and sealing is performed so that the fuel pressurized in the pressurizing chamber 11 at an upper end face of the cylinder 6 does not leak to a low-pressure side.

A tappet 92, which converts a rotational motion of the cam 93 attached to a camshaft of the internal combustion engine into an up-and-down motion and transmits the converted motion to the plunger 2, is provided at a lower end of the plunger 2. The plunger 2 is crimped to the tappet 92 by a spring 4 via a retainer 15. As a result, the plunger 2 can reciprocate up and down along with the rotational motion of the cam 93.

In addition, the plunger seal 13 held at a lower end portion of an inner circumference of a seal holder 7 is installed in the state of being slidably in contact with an outer circumference of the plunger 2 at a lower portion of the cylinder 6 in the drawing. As a result, when the plunger 2 slides, the fuel of an auxiliary chamber 7*a* is sealed to be prevented from flowing into the internal combustion engine. At the same time, lubricating oil (including engine oil) lubricating a sliding portion in the internal combustion engine is prevented from flowing into the pump body 1.

As illustrated in FIGS. 2 and 3, the intake joint 51 is attached to a side surface portion of the pump body 1 of the high-pressure fuel supply pump. The intake joint 51 is connected to a low-pressure pipe that supplies fuel from the fuel tank 20 of a vehicle, and the fuel is supplied to the inside of the high-pressure fuel supply pump from the intake joint 51. An intake filter 52 serves to prevent foreign matters present between the fuel tank 20 and the low-pressure fuel intake port 10*a* from being absorbed into the high-pressure fuel supply pump by the flow of fuel.

The fuel that has passed through the low-pressure fuel intake port 10*a* passes through a low-pressure fuel intake port 10*b* communicating in a vertical direction with the pump body 1 illustrated in FIG. 2 and flows toward the pressure pulsation reduction mechanism 9. The pressure pulsation reduction mechanism 9 is arranged between a damper cover 14 and an upper end face of the pump body 1 and is supported from the lower side by a holding member 9*a* arranged on the upper end face of the pump body 1. More specifically, the pressure pulsation reduction mechanism 9 is formed by superimposing two diaphragms on each other, and a gas is enclosed in the inside of the pressure pulsation reduction mechanism 9 at 0.3 MPa to 0.6 MPa, and an outer circumferential edge portion thereof is fixed by welding. Thus, the pressure pulsation reduction mechanism 9 is configured to be thin in the outer circumferential edge portion and become thicker toward the inner circumferential side.

Further, a convex portion configured to fix the outer circumferential edge portion of the pressure pulsation reduction mechanism 9 from the lower side is formed on an upper surface of the holding member 9*a*. On the other hand, a convex portion configured to fix the outer circumferential edge portion of the pressure pulsation reduction mechanism 9 from the upper side is formed on a lower surface of the damper cover 14. These convex portions are formed in a circular shape, and the pressure pulsation reduction mechanism 9 is fixed by being sandwiched by these convex portions. Incidentally, the damper cover 14 is press-fitted and fixed to the outer edge portion of the pump body 1, and at this time, the holding member 9*a* is elastically deformed to support the pressure pulsation reduction mechanism 9. In this manner, the damper chamber 10*c* communicating with the low-pressure fuel intake ports 10*a* and 10*b* is formed on the upper and lower surfaces of the pressure pulsation reduction mechanism 9. Although not illustrated in the drawing, a passage is formed in the holding member 9*a* to communicate the upper side with the lower side of the pressure pulsation reduction mechanism 9, and as a result, the damper chamber 10*c* is formed on the upper and lower surfaces of the pressure pulsation reduction mechanism 9.

The fuel that has passed through the damper chamber 10*c* then reaches an intake port 31*b* of the electromagnetic intake valve mechanism 300 via a low-pressure fuel flow path 10*d* formed to communicate in the vertical direction with the pump body. Incidentally, the intake port 31*b* is formed to communicate in the vertical direction with a seat member 31 forming an intake valve seat 31*a*.

As illustrated in FIG. 2, the discharge valve mechanism 8 provided at an outlet of the pressurizing chamber 11 is constituted by a discharge valve seat 8*a*, a discharge valve 8*b* which is brought into contact with or separated from the discharge valve seat 8*a*, a discharge valve spring 8*c* biasing the discharge valve 8*b* toward the discharge valve seat 8*a*, and a discharge valve stopper 8*d* defining a stroke (movement distance) of the discharge valve 8*b*. The discharge valve stopper 8*d* and the pump body 1 are joined to each other at an abutment portion 8*e* by welding to shut off the fuel from the outside.

In a state where there is no pressure difference of fuel between the pressurizing chamber 11 and a discharge valve chamber 12*a*, the discharge valve 8*b* is pressed against the discharge valve seat 8*a* by a biasing force generated by the discharge valve spring 8*c* and is turned into a closed valve state. The discharge valve 8*b* opens against the discharge valve spring 8*c* only when the fuel pressure in the pressurizing chamber 11 becomes larger than the fuel pressure in the discharge valve chamber 12*a*. Further, the high-pressure fuel in the pressurizing chamber 11 is discharged to the common rail 23 via the discharge valve chamber 12*a*, the fuel discharge passage 12*b*, and the fuel discharge port 12. When opening, the discharge valve 8*b* is brought into contact with the discharge valve stopper 8*d*, and the stroke is restricted. Therefore, the stroke of the discharge valve 8*b* is appropriately determined by the discharge valve stopper 8*d*. As a result, it is possible to prevent the fuel discharged at a high pressure into the discharge valve chamber 12*a* from flowing back into the pressurizing chamber 11 again because the stroke becomes too large and the discharge valve 8*b* is closed late, and it is possible to suppress deterioration in efficiency of the high-pressure fuel supply pump. In addition, the discharge valve 8*b* is guided along an outer circumferential surface of the discharge valve stopper 8*d* such that the discharge valve 8*b* moves only in the stroke direction at the time of repeatedly moving to open and be closed. In this manner, the discharge valve mechanism 8 serves as a check valve that restricts a flowing direction of the fuel.

As described above, the pressurizing chamber 11 is constituted by the pump housing 1, the electromagnetic intake valve mechanism 300, the plunger 2, the cylinder 6, and the discharge valve mechanism 8.

Here, details of the present embodiment will be described with reference to FIG. 4. FIG. 4 is an enlarged view of the electromagnetic intake valve 300 and is the view illustrating a non-energized state where the electromagnetic coil 43 is not energized and the pressure in the pressurizing chamber 11 is low (pressure pumped by the feed pump 21).

When the plunger 2 moves in the direction of the cam 93 by the rotation of the cam 93 and is in an intake step state, the volume of the pressurizing chamber 11 increases so that the fuel pressure in the pressurizing chamber 11 decreases.

In this stroke this step, when the fuel pressure in the pressurizing chamber 11 becomes lower than the pressure of the intake port 31*b*, the intake valve 30 is turned into the open valve state. A maximum opening degree is indicated by 30*a*, and at this time, the intake valve 30 is brought into contact with a stopper 32. When the intake valve 30 opens, an opening portion 31*c* formed in the seat member 31 opens. The fuel passes through the opening portion 31*c* and flows into the pressurizing chamber 11 via a hole if formed in the pump body 1 in the lateral direction. Incidentally, the hole if also forms a part of the pressurizing chamber 11.

After the plunger 2 finishes the intake step, the plunger 2 turns to upward movement and shifts to the ascending step. Here, the electromagnetic coil 43 is maintained in a non-energized state, and a magnetic biasing force does not act. A rod biasing spring 40 biases a rod convex portion 35*a* which is convex toward an outer diameter side of a rod 35 and is set so as to have a biasing force necessary and sufficient for keeping the intake valve 30 open in the non-energized state. Although the volume of the pressurizing chamber 11 decreases along with the upward movement of the plunger 2, the fuel, once taken into the pressurizing chamber 11, returns to the intake passage 10*d* through the opening portion 30*a* of the intake valve 30 in the open valve state again in this state, the pressure of the pressurizing chamber does not increase. This step is referred to as a return step.

In this state, when a control signal from the engine control unit 27 (hereinafter referred to as the ECU) is applied to the electromagnetic intake valve mechanism 300, a current flows through a terminal 46 to the electromagnetic coil 43. A magnetic attractive force acts between a magnetic core 39 and an anchor 36 so that the magnetic core 39 and the anchor 36 are brought into contact with a magnetic attraction surface S. The magnetic attractive force overcomes the biasing force of the rod biasing spring 40 to bias the anchor 36, and the anchor 36 is engaged with the rod convex portion 35*a* to move the rod 35 in a direction away from the intake valve 30.

At this time, the intake valve 30 is closed by a biasing force of an intake valve biasing spring 33 and a fluid force generated by the fuel flowing into the intake passage 10*d*. After the valve is closed, the fuel pressure of the pressurizing chamber 11 increases along with the upward movement of the plunger 2 to be equal to or higher than the pressure of the fuel discharge port 12, the fuel is discharged at a high pressure through the discharge valve mechanism 8 and is supplied to the common rail 23. This step is referred to as a discharge step.

That is, the ascending step between a lower start point and an upper start point of the plunger 2 includes the return step and the discharge step. Then, it is possible to control the amount of the high-pressure fuel to be discharged by controlling a timing of energization to the coil 43 of the electromagnetic intake valve mechanism 300. When the electromagnetic coil 43 is energized at an early timing, the proportion of the return step is small and the proportion of the discharge step is large during a compression step. That is, the amount of fuel returning to the intake passage 10*d* is small, and the amount of fuel to be discharged at a high pressure becomes large. On the other hand, if the energization timing is delayed, the proportion of the return step is large and the proportion of the discharge step is small during the compression step. That is, the amount of fuel returning to the intake passage 10*d* is large, and the amount of fuel to be discharged at a high pressure becomes small. The energization timing to the electromagnetic coil 43 is controlled by a command from the ECU 27. With the above configuration, it is possible to control the amount of fuel to be discharged at a high pressure to the amount required by the internal combustion engine by controlling the energization timing to the electromagnetic coil 43.

An intake valve portion is constituted by the intake valve 30, the seat member 31, an intake valve stopper 32, and an intake valve biasing spring 33. The intake valve seat 31 is a cylindrical type, has intake valve seat 31*a* on an axially inner circumferential side and one or two or more intake passage portions 31*b* radially around the axis of the cylinder, and is press-fitted and held in the pump body 1 on a cylindrical surface of an outer circumference.

The intake valve biasing spring 33 is partially arranged on an inner circumferential side of the intake valve stopper 32 in a small diameter portion for coaxially stabilizing one end of the spring, and the intake valve 30 is configured in the form in which the intake valve biasing spring 33 is fitted to a valve guide portion 30*b* between the intake valve seat 31*a* and the intake valve stopper 32. The intake valve biasing spring 33 is a compression coil spring and is installed such that a biasing force acts in a direction in which the intake valve 30 is pressed against the intake valve seat portion 31*a*. Any form may be used as long as it is possible to obtain the biasing force without being limited to the compression coil spring, and a leaf spring having a biasing force and integrated with an intake valve may be also used.

As the intake valve portion is configured in this manner, the fuel that has passed through the intake passage 31*b* and entered the inside flows between the intake valve 30 and the intake valve seat 31*a*, passes through a fuel passage in a gap between an outer circumferential side of the intake valve 30 and the intake valve stopper 32, and passes through passages of the pump body 1 and the cylinder, and the fuel is caused to flow into a pump chamber in the intake step of the pump. In addition, the discharge valve 30 is brought into contact with the intake valve seat 31*a* to perform sealing in a discharge step of the pump, thereby fulfilling the function as the check valve that prevents backflow of fuel toward the inlet side.

An axial movement amount 30*a* of the intake valve 30 is restricted to a finite extent by the intake valve stopper 32. This is because the backflow amount increases due to a response delay at the time of closing the intake valve 30, and the performance of the pump deteriorates if the movement amount is too large. The restriction on the movement amount can be defined by shapes and dimensions in the axial direction and press-fitting positions of the intake valve seat 31*a*, the intake valve 30, and the intake valve stopper 32.

The intake valve 30, the intake valve seat 31*a*, and the intake valve stopper 32 repeatedly collide with each other when being operated, and thus, are formed using a material obtained by performing heat treatment on martensitic stainless steel which has high strength and high hardness and is also excellent in corrosion resistance. For the intake valve biasing spring 33, an austenitic stainless steel material is used in consideration of corrosion resistance.

Next, a solenoid mechanism will be described. The solenoid mechanism is constituted by the rod 35 as a movable portion, the anchor 36, a rod guide 31*e* as a fixing portion, a first core 38, a second core 39, the rod biasing spring 40, and an anchor biasing spring 41.

The rod 35 as the movable portion and the anchor 36 are formed as separate members. The rod 35 is held to be slidable in the axial direction on an inner circumferential side of the rod guide 31*e*, and an inner circumferential side of the anchor 36 is held slidably on an outer circumferential side of the rod 35. That is, both the rod 35 and the anchor 36 are configured to be slidable in the axial direction within a range geometrically restricted.

The anchor 36 has one or more through-holes 36*a* penetrating in a component axial direction to eliminate restrictions on movement caused by a pressure difference before and after the anchor as much as possible in order to move freely and smoothly in the fuel in the axial direction. The rod guide 31*e* is arranged in the form of being inserted to an inner circumferential side of a hole to which the intake valve of the pump body 1 is inserted with respect to the radial direction and abutting on one end portion of the intake valve seat and being sandwiched between the first core 38 welded and fixed to the pump body 1 and the pump body 1 with respect to the axial direction. Similarly to the anchor 36, the rod guide 31*e* is also provided with a through-hole penetrating in the axial direction and is configured such that the anchor can move freely and smoothly and the pressure of the fuel chamber on the anchor side does not hinder the movement of the anchor.

A shape of the first core 38 on the side opposite to the part thereof to be welded to the pump body is a thin-walled cylindrical shape, and the first core 38 is welded and fixed in such a manner that the second core 39 is inserted into an inner circumferential side thereof. The rod biasing spring 40 is arranged on an inner peripheral side of the second core 39 with the small diameter portion as a guide, the rod 35 comes into contact with the intake valve 30, and the intake valve applies a biasing force in a direction away from the intake valve seat 31*a*, that is, in the valve-opening direction of the intake valve.

The anchor biasing spring 41 is arranged so as to have one end inserted into a guide portion having a cylindrical diameter provided on the center side of the rod guide 31*e* and to apply a biasing force in a direction of a rod flange portion 35*a* to the anchor 36 while being maintained to be coaxial. A movement amount 36*e* of the anchor 36 is set to be larger than the movement amount 30*a* of the intake valve 30. This aims to reliably close the intake valve 30.

A material obtained by performing heat treatment on martensitic stainless steel in consideration of hardness and corrosion resistance is used since the rod 35 and the rod guide 31*e* slide on each other and the rod 35 repeatedly collide with the intake valve 30. The anchor 36 and the second core 39 are made using magnetic stainless steel in order to form a magnetic circuit, and further, collision surfaces of the anchor 36 and the second core are subjected to surface treatment in order to improve the hardness. In particular, hard Cr plating or the like is performed, but the surface treatment is not limited thereto. The rod biasing spring 40 and the anchor biasing spring 41 are made using austenitic stainless steel in consideration of corrosion resistance.

Three springs are configured for the intake valve portion and the solenoid mechanism. The intake valve biasing spring 33 formed in the intake valve portion and the rod biasing spring and the anchor biasing spring formed in the solenoid mechanism are configured. In the present embodiment, any of the springs uses a coil spring, but any spring can be configured as long as it is possible to obtain a biasing force.

A relationship among these three spring forces is configured by the following formula.

Biasing Force of Rod Biasing Spring 40>Biasing Force of Anchor Biasing Spring 41+Biasing Force of Intake Valve Biasing Spring 33+Force Generated by Fluid to Close Intake Valve — Formula (1)

With this relationship, a force f1 acts on the rod 35 in the direction to separate the intake valve 30 from the intake valve seat 31*a*, that is, in the direction in which the valve opens due to each spring force in the non-energized state. From Formula (1), f1 is obtained as follows.

$f1$=Biasing Force of Rod Biasing Spring 40−(Biasing Force of Anchor Biasing Spring 41+Biasing Force of Intake Valve Biasing Spring 33+Force Generated by Fluid to Close Intake Valve) Formula (2)

Next, a configuration of a coil portion will be described. The coil portion is constituted by a first yoke 42, an electromagnetic coil 43, a second yoke 44, a bobbin 45, terminals 46, and a connector 47. The coil 43 obtained by winding a copper wire around the bobbin 45 a plurality of times is arranged in the form of being surrounded by the first yoke 42 and the second yoke and is molded integrally with the connector, which is a resin member, and fixed. One end of each of the two terminals 46 is connected to each of both ends of the copper wire of the coil so as to be energizable. The terminals 46 are also molded integrally with the connector in the same manner, and the remaining ends are connectable to the engine control unit side.

In the coil portion, a hole at a center portion of the first yoke is press-fitted and fixed in the first core. At that time, an inner diameter side of the second yoke 44 comes into contact with the second core or becomes close thereto with a slight clearance. Both the first yoke 42 and the second yoke 44 are made using a magnetic stainless steel material in consideration of corrosion resistance in order to form a magnetic circuit, and the bobbin 45 and the connector 47 are made using a high-strength heat-resistant resin in consideration of strength characteristics and heat resistance characteristics. The coil 43 is made using copper, and the terminal 46 is made using metal-plated brass.

Since the solenoid mechanism and the coil are configured as described above, the magnetic circuit is formed by the first core 38, the first yoke 42, the second yoke 44, the second core 39, and the anchor 36, and an electromagnetic force is generated between the second core 39 and the anchor 36 to generate a force that attracts each other when a current is applied to the coil. When an axial part of the first core 38 where the second core 39 and the anchor 36 mutually generate attractive forces is formed as thin as possible, substantially the entire magnetic flux passes between the second core and the anchor, and thus, it is possible to efficiently obtain the electromagnetic force.

When the electromagnetic force exceeds the above-described force f1, the movement of the anchor 36 as the movable portion to be drawn to the second core 39 together with the rod 35, and the contact between the core 39 and the anchor 36 and the continuation of the contact are possible.

When the plunger 2 starts to descend from an upper dead center, the pressure inside the pressurizing chamber rapidly decreases from a high-pressure state at a level of, for example, 20 MPa, and the rod 35, the anchor 36, and the intake valve 30 start to move in the valve-opening direction of the intake valve 30 by the force f1. When the intake valve 30 opens, the fuel having flown into the inner diameter side of the seat member 31 from the passage 31*b* of the intake valve seat starts to be sucked into the pressurizing chamber.

The intake valve 30 collides with the intake valve stopper 32, and the intake valve 30 stops at that position. Similarly, the rod 35 also stops at a position where a distal end thereof comes into contact with the intake valve 30 (a valve-opening position of the plunger rod). The anchor 36 also moves in the valve-opening direction of the intake valve 30 at the same speed as the rod 35, but tries to continue moving by an inertia force even after the rod 35 comes in contact with the intake valve 30 and stops. Meanwhile, the anchor biasing spring 41 overcomes the inertia force so that the anchor 36 moves in the direction to approach the second core 39 again, and the anchor 36 can stop at a contact position (a valve-opening position of the anchor) in the form of being pressed against the rod convex portion 35*a*. The state of FIG. 4 is a state illustrating positions of the anchor 36, the rod 35, and the intake valve 30 at this time.

Although it has been described that the rod 35 and the anchor 36 are completely separated from each other in the above description, the rod 35 and the anchor 36 may remain in the state of being in contact with each other. In other words, a load acting on the contact portion between the rod convex portion 35*a* and the anchor 36 decreases after the rod stops moving, and the anchor 36 starts to be separated from the rod when the load becomes zero. However, a force of the anchor biasing spring 41 may be set such that the load does not become zero and leaves a slight load.

When the intake valve 30 collides with the intake valve stopper 32, there occurs a problem of abnormal sound which is an important characteristic as a product. The magnitude of the abnormal sound depends on the magnitude of energy at the time of the collision. Since the rod 35 and the anchor 36 are configured as separate components, the energy colliding with the intake valve stopper 32 is generated only by the mass of the intake valve 30 and the mass of the rod 35. That is, the mass of the anchor 36 does not contribute to the collision energy, and thus, the problem of the abnormal sound is reduced when the rod 35 and the anchor 36 are configured as separate components.

Even if the rod 35 and the anchor 36 are configured as separate components, the anchor 36 continues to move in the valve-opening direction of the intake valve 30 by the inertia force and collides with a central bearing portion of the rod guide 31*e* in a configuration in which the anchor biasing spring 41 is not provided so that there occurs a problem that abnormal sound is generated in a part different from the collision portion. In addition to the problem of the abnormal sound, the collision causes wear or deformation of the anchor 36 and the rod guide 31*e*, and metal foreign matters are generated due to such wear. As the foreign matters are caught by the sliding portion or the seat portion or the deformation impairs a bearing function, there is a risk that a function of the intake valve solenoid mechanism may be impaired.

In addition, the anchor is separated from the core 39 too much by the inertial force in the configuration in which the anchor biasing spring 41 is not provided, and thus, there occurs a problem that it is difficult to obtain a necessary electromagnetic attractive force when a current is applied to the coil portion so as to make the transition from a return step, which is the post step in terms of an operation timing, to the discharge step. When it is difficult to obtain the necessary electromagnetic attractive force, it is difficult to control the fuel to be discharged from the high-pressure pump to a desired flow rate, which is a big problem. Thus, the anchor biasing spring 41 has an important function to prevent the above problems from occurring.

After the intake valve 30 opens, the plunger 2 further descends to reach a lower dead center. During this time, the fuel continues to flow into the pressurizing chamber 11, and this step is the intake step.

<<Return Step>>

The plunger 2 descending to the lower dead center enters an ascending step. The intake valve remains stopped in the open valve state by the force f1, and a direction of fluid passing through the intake valve is reversed. That is, while, in the intake step, the fuel has flown into the pressurizing chamber from the intake valve seat passage 31*b*, the fuel is, upon entering the ascending step, returned from the pressurizing chamber to the direction of the intake valve seat passage 31*b*. This step is referred to as a return step.

In this return step, a valve closing force of the intake valve generated by the returning fluid increases and the force f1 decreases under a condition that the engine rotates at a high speed, that is, ascending speed of the plunger 2 is high. Under such a condition, the intake valve 30 is unintentionally closed when a set force of each spring force has an error so that f1 becomes a negative value. Since a flow rate higher than a desired discharge flow rate is discharged, pressure inside a fuel pipe rises above a desired pressure, which adversely affects combustion control of the engine. Thus, it is necessary to set each spring force such that the force f1 keeps a positive value under the condition that the ascending speed of the plunger 2 is the highest.

<<Transition State to Return Step to Discharge Step>>

A current is applied to the electromagnetic coil 43 at a timing earlier than a desired discharge timing obtained in consideration of a delay in generation of an electromagnetic force and a delay in closing of the intake valve, and thus, a magnetic attractive force is exerted between the anchor 36 and the second core 39. It is necessary to supply the current corresponding to the magnitude required for overcoming the force f1. When the magnetic attractive force overcomes the force f1, the anchor 36 starts to move in the direction of the second core 39. As the anchor 36 moves, the rod 35 that is in contact with the flange portion 35*a* also moves in the axial direction, and the intake valve 30 starts to open due to a force of the intake valve biasing spring 33 and a force of fluid, and mainly, a decrease in the static pressure caused by flow velocity passing through the seat portion from the pressurizing chamber side.

In a case where the anchor 36 and the second core 39 are separated too much farther than a specified distance, that is, a case where a state where the anchor 36 exceeds the valve opening position continues, the magnetic attractive force is weak, and thus, hardly overcomes the force f1 when the current is applied to the electromagnetic coil 43. Thus, there occurs a problem that it takes time for the anchor to move toward the second core 39 or the anchor is not movable. The anchor biasing spring 41 is provided in order not to cause such a problem. When the anchor 36 is not movable to the second core 39 at a desired timing, the open state of the intake valve is maintained even at a desired discharge timing, and thus, it is difficult to start the discharge step, that is, it is difficult to obtain a required discharge amount so that there is a concern that it is difficult to perform desired engine combustion Thus, the anchor biasing spring 41 has the important function to prevent the problem of the abnormal sound that may occur in the intake step and the problem that the discharge step is hardly started.

The intake valve 30 having started to move collides with the intake valve seat 31*a* and stops to be a closed valve state. When the valve is closed, the in-cylinder pressure rapidly increases and thus, the intake valve 30 is strongly pressed with a force much larger than the force f1 in a valve closing direction by the in-cylinder pressure, and starts to maintain the closed valve state.

The anchor 36 also collides with the second core 39 and stops. The rod 35 continues to move by the inertial force even after the anchor 36 stops, but the rod biasing spring 40 overcomes the inertial force to push back the rod 35 so that the rod 35 is returned to the position where the flange portion 35*a* is in contact with the anchor.

When the anchor 36 collides with the second core 39, there occurs a problem of abnormal sound which is an important characteristic as a product. This abnormal sound is greater than the magnitude of the abnormal sound generated when the intake valve and the intake valve stopper collide with each other, and thus, is more problematic. The magnitude of the abnormal sound depends on the magnitude of energy at the time of the collision. Since the rod 35 and the anchor 36 are configured as separate components, the energy colliding with the second core 39 is generated only by the mass of the anchor 36. That is, the mass of the rod 35 does not contribute to the collision energy, and thus, the problem of the abnormal sound is reduced when the rod 35 and the anchor 36 are configured as separate components. Once the anchor 36 comes into contact with the second core 39, a sufficient magnetic attractive force is generated by the contact, and thus, it is possible to set a small current value only to hold the contact.

Here, a problem of erosion which may occur in the solenoid mechanism will be described. When a current is applied to the coil and the anchor 36 is drawn to the second core 39, a space volume between the two objects rapidly decreases, and the fluid present in the space loses a place to go, is swept toward the outer circumferential side of the anchor with fast flow, and collides with a thin portion of the first core, so that there is a concern that such energy may cause erosion. In addition, the swept fluid passes through the outer circumference of the anchor and flows toward the rod guide, but the flow velocity increases, that is, cavitation occurs due to a rapid decrease of static pressure because a passage on the outer circumferential side of the anchor is narrow, so that there is a concern that cavitation erosion may occur in the thin portion of the first core.

In order to avoid these problems, the one or more through-holes 36*a* in the axial direction are provided on the anchor center side. This aims to cause the fluid in the space not to pass through the narrow passage on the outer circumferential side of the anchor as much as possible but to pass through the through-hole 36*a* when the anchor 36 is drawn toward the second core 39. With such a configuration, it is possible to solve the problem of the erosion.

When the anchor 36 and the rod 35 are integrally configured, there is a more concern on the above problem. Under the condition that the engine rotates at a high speed, that is, the ascending speed of the plunger is high, a force to close the intake valve 30 generated by fluid at an extremely high speed is increased as an additionally applied force in addition to the force of the anchor 36 trying to move to the second core 39 generated when the current is applied to the coil, and the rod 35 and the anchor 36 rapidly approach the second core 39. Thus, the speed at which the fluid inside the space is pushed out further increases, and the problem of the erosion becomes more severe. It is difficult to solve the problem of the erosion if the capacity of the through-hole 36*a* of the anchor 36 is insufficient. Since the anchor 36 and the rod 35 are configured as separate components in the present embodiment, only the rod 35 is pushed out toward the second core 39 even when the force to close the intake valve 30 is applied to the rod 35, and the anchor 36 is moved toward the second core 39 only with the force of the normal electromagnetic attractive force while being left behind. That is, the rapid decrease of the space does not occur, and the problem of the erosion can be prevented.

Negative effects of configuring the anchor 36 and the rod 35 as separate components are the problem that it is difficult to obtain the desired magnetic attractive force, the abnormal sound, and the deterioration in the function as described above. Such negative effects can be gotten rid of by installing the anchor biasing spring 41.

<<Discharge Step>>

Immediately after ending of the return step in which the plunger is turned into the ascending step from the lower dead center, and a current is applied to the coil 43 at a desired timing so that the intake valve 30 is closed, the pressure inside the pressurizing chamber rapidly increases, and the discharge step is started. It is desirable to reduce the power to be applied to the coil after the discharge step from the viewpoint of power saving, and thus, the current to be applied to the coil is cut off. No electromagnetic force is applied so that the anchor 36 and the rod 35 move in the direction away from the second core 39 by a resultant force of the rod biasing spring 40 and the anchor biasing spring 41. However, the rod 35 stops at the position where the rod 35 has collided with the intake valve 30 in the closed valve state since the intake valve 30 is at a valve closing position with a strong valve closing force. That is, the amount of movement of the rod at this time is (36*e*-30*a*).

Although the rod 35 and the anchor 36 simultaneously move after the current is cut off, the anchor 36 tries to continue moving in the direction of the intake valve 30 by the inertial force even after the rod 35 stops in a state where the distal end of the rod 35 comes into contact with the closed intake valve 30. However, the anchor 36 can be stopped in the state of coming into contact with the flange portion 35*a* of the rod 35 since the anchor biasing spring 41 overcomes the inertial force and applies the biasing force to the anchor 36 in the direction of the second core 39.

When the anchor biasing spring 41 is not provided, the anchor moves in the direction of the intake valve 30 without stopping similarly to the above description regarding the intake step so that there is a concern on the problem of abnormal sound generated by the collision with the rod guide portion 31*e* and the problem of dysfunction. However, the above problems can be prevented since the anchor biasing spring 41 is installed. Incidentally, the rod guide portion 31*e* is integrally configured using the same member with the seat member 31 in the present embodiment.

The discharge step in which the fuel is discharged is performed in this manner, and the intake valve 30, the rod 35, and the anchor 36 are set in the state illustrated in FIG. 5 immediately before the next intake step. When the plunger reaches the upper dead center, the discharge step is ended, and the intake step is started again. In this manner, it is possible to provide the high-pressure pump suitable to enable the required amount of the fuel, guided to the low-pressure fuel intake port 10*a*, to be pressurized to high pressure by a reciprocating motion of the plunger 2 in the pressurizing chamber 11 of the pump body 1, and to be pumped from the fuel discharge port 12 to the common rail 23. Here, an inclination when the intake valve and the rod collide with each other increases in the electromagnetic intake valves of the conventional high-pressure fuel supply pumps described in the above-described PTLs 1 and 2. When the intake valve and the rod collide with each other in the inclined state, the rod collides with the intake valve in a corner contact state, and thus, there is a problem that stress concentration occurs to cause wear. Therefore, a configuration of preventing generation of wear at a rod collision portion in an electromagnetic intake valve of a high-pressure fuel supply pump by reducing inclinations of the intake valve and a rod will be described hereinafter. The high-pressure fuel supply pump of the present embodiment includes: the intake valve 30 that has a planar portion 30*d*; the rod portion 35 that biases the planar portion 30*d* in the valve-opening direction; and the seat member 31 that is formed at a position parallel to the planar portion 30*d* and has the intake valve seat 31*a* on which the intake valve 30 is seated. The seat member 31 is formed with a guide portion 31*d* which guides the rod portion 35 on the side opposite to the intake valve 30 with respect to a contact position between the rod portion 35 and the planar portion 30*d*.

In addition, the planar portion 30*d* of the intake valve 30 and the intake valve seat 31*a* of the seat member 31 are formed on substantially the same plane. In addition, the planar portion 30*d* of the intake valve 30 and a central axis of the rod portion 35 are arranged to be orthogonal to each other. In addition, the seat member 31 is formed with a fuel passage 31*b* into which fuel from a low-pressure flow path flows, and the guide portion 31*e* is arranged on the side opposite to the intake valve seat 31*a* with respect to an opening portion of the fuel passage 31*b*. In addition, the seat member 31 is formed with a fuel passage 31*b* into which fuel from a low-pressure flow path flows, and the guide portion 31*e* is entirely arranged on the side opposite to the intake valve seat 31*a* with respect to an opening portion of the fuel passage 31*b*. In addition, the seat member 31 is formed with a fuel passage 31*b* into which fuel from a low-pressure flow path flows, and the intake valve seat 31*a* is arranged on the pressurizing chamber 11 side with respect to the opening portion of the fuel passage 31*b*. In addition, the seat member 31 is formed with a fuel passage 31*b* into which fuel from a low-pressure flow path flows, and the entire intake valve seat 31*a* is arranged on the pressurizing chamber 11 side with respect to the opening portion of the fuel passage 31*b*.

In addition, a movable portion 36 which generates a magnetic attractive force is integrally attached to the rod portion 35, and the seat member 31, the guide portion 31*e*, and the movable portion 36 are arranged such that a length of the guide portion 31*e* of the rod portion 35 becomes longer than a length of an opposing surface between the rod portion 35 and the movable portion 36 in a rod central axis direction. Alternatively, the movable portion 36 which generates the magnetic attractive force is separately attached to the rod portion 35, and the seat member 31, the guide portion 31*e*, and the movable portion 36 are arranged such that a length of the guide portion 31*e* of the rod portion 35 becomes longer than a length of an opposing surface between the rod portion 35 and the movable portion 36 in a rod central axis direction in a state where the rod portion 35 and the movable portion 36 are engaged with each other. The rod portion 35 and the intake valve 30 are configured as separate members. The rod portion 35 and the intake valve 30 are configured as separate members, and the rod portion 35 and the seat member 31 are configured such that a length of the guide portion 31*e* in the rod central axis direction is a half of a total length of the rod portion 35 or longer.

With the above configuration, it is possible to suppress the collision in the state where the rod is inclined. As a result, it is possible to prevent the collision of the rod in corner contact state and to solve the problem of stress concentration and wear.

A low-pressure fuel chamber 10 is provided with the pressure pulsation reduction mechanism 9 that reduces the influence of pressure pulsation, generated in the high-pressure fuel supply pump, to the fuel pipe 28. When the fuel, which has once flown into the pressurizing chamber 11, is returned to the intake passage 10*d* again through the intake valve body 30 that is in the open valve state for capacity control, the pressure pulsation occurs in the low-pressure fuel chamber 10 due to the fuel returned to the intake passage 10*d*. However, the pressure pulsation reduction mechanism 9 provided in the low-pressure fuel chamber 10 is formed of a metal diaphragm damper, which is formed by affixing two corrugated disk-shaped metal plates together at outer circumferences thereof and injecting an inert gas such as argon into the inside thereof, and the pressure pulsation is reduced by absorption by expansion and contraction of this metal damper.

The plunger 2 has a large-diameter portion 2*a* and a small-diameter portion 2*b*, and the volume of the auxiliary chamber 7*a* is increased or decreased by the reciprocating motion of the plunger. The auxiliary chamber 7*a* communicates with the low-pressure fuel chamber 10 through a fuel passage 10*e*. The flow of fuel is generated from the auxiliary chamber 7*a* to the low-pressure fuel chamber 10 when the plunger 2 descends, and is generated from the low-pressure fuel chamber 10 to the auxiliary chamber 7*a* when the plunger 2 ascends.

As a result, it is possible to reduce a fuel flow rate to the inside or outside of the pump in the intake stroke or return stroke of the pump so as to serve a function of reducing the pressure pulsation that occurs inside the high-pressure fuel supply pump.

Next, the relief valve mechanism 200 illustrated in FIGS. 1 and 2 will be described. The relief valve mechanism 200 is constituted by a relief body 201, a relief valve 202, a relief valve holder 203, a relief spring 204, and a spring stopper 205. The relief body 201 is provided with a tapered seat portion 201*a*. As a load of the relief spring 204 is loaded via the valve holder 203, the valve 202 is pressed against the seat portion 201*a* to shut off the fuel in cooperation with the seat portion 201*a*. A valve-opening pressure of the relief valve 202 is determined by the load of the relief spring 204. The spring stopper 205 is a mechanism that is press-fitted and fixed to the relief body 201 and adjusts the load of the relief spring 204 in accordance with a press-fit and fixing position.

Here, when the fuel in the pressurizing chamber 11 is pressurized and the discharge valve 8*b* opens, the high-pressure fuel inside the pressurizing chamber 11 passes through the discharge valve chamber 12*a* and the fuel discharge passage 12*b* and is discharged from the fuel discharge port 12. The fuel discharge port 12 is formed in a discharge joint 60, and the discharge joint 60 is welded and fixed to the pump body 1 at a weld portion 61 to secure the fuel passage. In the present embodiment, the relief valve mechanism 200 is arranged in a space formed inside the discharge joint 60. That is, an outermost-diameter portion (in the present embodiment, an outermost diameter portion of the relief body 201) of the relief valve mechanism 200 is arranged on the inner circumferential side of an inner diameter portion of the discharge joint 60, and the relief valve mechanism 200 is arranged such that the relief valve mechanism 200 at least partially overlaps with the discharge joint 60 in its axial direction as the pump body 1 is viewed from above.

Incidentally, it is desirable that the relief valve mechanism 200 be inserted directly into the hole formed in the pump body 1 and arranged in a non-contact manner with the discharge joint 60. As a result, even if the shape of the discharge joint 60 is changed, it is not necessary to change the shape of the relief valve mechanism 200 in response to such a change so that it is possible to achieve cost reduction.

That is, a first hole 1*c* (lateral hole) is formed from the outer circumferential surface of the pump body 1 toward the inner circumferential side in a direction (lateral direction) orthogonal to the axial direction of the plunger in the present embodiment as illustrated in FIG. 1. Further, the relief valve mechanism 200 is arranged by press-fitting the relief body 201 into the first hole 1*c* (lateral hole). In the present embodiment, when the relief valve mechanism 200 opens in communication with the first hole 1*c* (lateral hole), a second hole 1*d* (vertical hole) for returning the fuel in the discharge-side flow path of the discharge valve 8*b* pressurized in the pressurizing chamber 11 to the damper chamber 10*c* is formed in the pump body 1.

More specifically, when the relief valve 202 opens, the discharge-side flow path (fuel discharge port 12) and an internal space of the relief body 201 communicate with each other. The relief valve holder 203, the relief spring 204, and the spring stopper 205 are arranged in this internal space. When the spring stopper 205 is viewed in the axial direction of the relief valve, a hole is formed in the center portion thereof, whereby the internal space of the relief body 201 and a relief passage 213 formed by the second hole 1*d* (vertical hole) are connected to each other. An end portion of the relief body 201 on a side where the spring stopper 205 is arranged is an opening portion, and the relief valve 202, the relief valve holder 203, the relief spring 204, and the spring stopper 205 are inserted in this order from this opening portion to form the relief valve mechanism 200.

The second hole (vertical hole) is formed from the outer circumference of the relief spring 204 toward the damper chamber 10*c*. Further, when the relief valve 202 opens, the fuel in the internal space of the relief body 201 flows into the damper chamber 10*c* through the hole in the center portion of the spring stopper 205, the opening portion of the relief body 201, and the relief passage 213.

When the high-pressure fuel supply pump is normally operating, the fuel pressurized by the pressurizing chamber 11 passes through the fuel discharge passage 12*b* and is discharged from the fuel discharge port 12 at a high pressure. In the present embodiment, a target fuel pressure of the common rail 23 is set to 35 MPa. The pressure inside the common rail 23 repeats pulsation over time, but an average value thereof is 35 MPa.

Immediately after start of a pressurization stroke, the pressure in the pressurizing chamber 11 sharply rises to rise above the pressure inside the common rail 23, and rises to about 43 MPa as a peak value in the present embodiment, and accordingly, the pressure of the fuel discharge port 12 also rises and rises to about 41.5 MPa at a peak in the present embodiment. In the present embodiment, a peak valve opening pressure of the relief valve mechanism 200 is set to 42 MPa, and the pressure of the fuel discharge port 12, which is an inlet of the relief valve mechanism 200, is set so as not to exceed the valve opening pressure, and the relief valve mechanism 200 does not open.

Next, a case where abnormally high-pressure fuel is generated will be described. If the pressure of the fuel discharge port 12 becomes abnormally high due to a failure of the electromagnetic intake valve 300 of the high-pressure fuel supply pump, and exceeds a set pressure of the relief valve mechanism 200 of 42 MPa, the abnormally high-pressure fuel is relieved to the damper chamber 10*c* on the low-pressure side via the relief passage 213.

An advantage of the configuration in which the abnormally high-pressure fuel is relieved to the low-pressure side (the damper chamber 10*c* in the present embodiment) will be described. It is possible to relieve the abnormally high-pressure fuel generated due to the failure or the like of the high-pressure fuel supply pump to a low pressure in all steps of the intake stroke, the return stroke, and the discharge stroke. On the other hand, when the pressurizing chamber 11 is configured to relieve the abnormally high-pressure fuel, it is possible to relieve the abnormally high-pressure fuel to the pressurizing chamber 11 only in the intake stroke and the return stroke, and it is not allowed to relieve the abnormally high-pressure fuel in the pressurization stroke. Since the outlet of the relief valve is the pressurizing chamber 11, the pressure in the pressurizing chamber 11 rises and a differential pressure between the inlet and the outlet of the relief valve does not become equal to or higher than a set pressure of the relief spring in the pressurization stroke. As a result, the time to relieve the abnormally high-pressure fuel is shortened and the relief function deteriorates. Incidentally, the relief is performed to return to the low-pressure side in the present embodiment.

In the present embodiment, the relief valve mechanism 200 is assembled externally as a subassembly before being mounted to the pump body 1. After the assembled relief valve mechanism 200 is press-fitted and fixed to the pump body 1, the discharge joint 60 is welded and fixed to the pump body 1. Further, the present embodiment is configured such that at least a part of the relief valve mechanism 200 arranged in the first hole 1*c* (lateral hole) is arranged on the pressurizing chamber side (upper side in FIG. 1) with respect to an uppermost end portion 6*b* on the pressurizing chamber side of the cylinder 6 as illustrated in FIG. 1.

That is, when the entire relief valve mechanism 200 is positioned on the side opposite (lower side in FIG. 1) to the pressurizing chamber 11 with respect to the uppermost end portion 6*b* on the pressurizing chamber side of the cylinder 6, the pump body 1 between the relief valve mechanism 200 or the second hole 1*d* (vertical hole) and the cylinder 6 becomes thin. When the relief valve mechanism 200 opens, the abnormally high-pressure fuel flows into the internal space of the relief body 201 and the second hole 1*d* (vertical hole). Therefore, from the viewpoint of reliability, it is important to increase the thickness of the pump body 1 between the relief valve mechanism 200 or the second hole 1*d* (vertical hole) and the cylinder 6 to some extent. Conversely, if this thickness is thin, the thickness between the pump body and the pressurizing chamber becomes thin, which leads to deterioration in reliability when the abnormally high-pressure fuel flows.

To deal with the above problem, the relief valve mechanism 200 is arranged as in the present embodiment described above to be able to obtain a sufficient thickness, so that the improvement in reliability can be achieved. Incidentally, it is desirable to position the entire relief valve mechanism 200 on the upper side with respect to the uppermost end portion 6*b* on the pressurizing chamber side of the cylinder 6 as illustrated in FIG. 1 in order to obtain a sufficient thickness of the relief valve mechanism 200 and the pressurizing chamber 11.

In addition, it is desirable to arrange the relief valve mechanism 200 arranged in the first hole 1*c* (lateral hole) on the cylinder side (lower side in FIG. 1) of an uppermost end portion 11*a* on the opposite cylinder side (upper side in FIG. 1) of the pressurizing chamber 11 as illustrated in FIG. 1. More specifically, it is desirable to arrange the relief valve mechanism 200 between the uppermost end portion 11*a* on the opposite cylinder side of the pressurizing chamber 11 and the uppermost end portion 6*b* on the pressurizing chamber side of the cylinder 6.

In this manner, it is possible to provide the relief valve mechanism 200 on the same plane as the discharge joint 60, the electromagnetic intake valve mechanism 300, and the discharge valve mechanism 8, and to improve workability in terms of producing the pump body 1. More specifically, a central axis of the relief valve mechanism 200, that is, a central axis of the relief body 201, the relief valve holder 203, or the spring stopper 205 is arranged on a substantially straight line with a central axis of the electromagnetic intake valve mechanism 300 (rod 35). Therefore, it is possible to improve an assembly property of the high-pressure fuel supply pump.

In addition, a position 1*e* at which an upper end portion of the first hole 1*c* (lateral hole) is connected to the second hole 1*d* (vertical hole) is arranged on the pressurizing chamber side (upper side in FIG. 1) with respect to the uppermost end portion 6*b* on the pressurizing chamber side of the cylinder 6 as illustrated in FIG. 1. Further, the position 1*e* at which the upper end portion of the first hole 1*c* (lateral hole) is connected to the second hole 1*d* (vertical hole) is desirably positioned on the lower side with respect to the uppermost end portion 11*a* on the opposite cylinder side of the pressurizing chamber 11. As a result, it is possible to obtain a sufficient thickness of the pump body 1 between the relief valve mechanism 200 or the second hole 1*d* (vertical hole) and the cylinder 6, and thus, it is possible to secure the reliability while miniaturizing the fuel supply pump.

Incidentally, it is possible to easily form the relief passage 213 by forming the second hole 1*d* (vertical hole) downward from an opening portion 213*a* of the pump body 1 with respect to the first hole 1*c* (lateral hole) to communicate with the first hole 1*c* (lateral hole), in the present embodiment. In addition, the discharge joint 60 is arranged so as to cover the first hole 1*c* (lateral hole), and the relief valve mechanism 200 is arranged at the inner side of the discharge joint 60, and thus, it is possible to avoid size increases of the pump body 1 and the high-pressure fuel supply pump.

The high-pressure fuel supply pump is configured such that the entire relief passage 213 is formed on the inner circumferential side with respect to the outermost circumferential portion of the pressure pulsation reduction mechanism 9, as viewed from the axial direction of the plunger 2. As a result, it is possible to provide a configuration in which the abnormally high-pressure fuel is released to a low-pressure passage 10*c* without increasing the size of the pump body 1. It is desirable to configure a diameter of the first hole 1*c* (lateral hole) to be larger than a diameter of the second hole 1*d* (vertical hole). Since the relief valve 200 is press-fitted into a bottom of the first hole 1*c* (lateral hole), a bottom surface of the first hole serves as a stopper of the relief valve 200.

Since the relief body 201 is provided in the present embodiment, the diameter of the first hole 1*c* (lateral hole) is the same as an outer diameter of the relief body. In addition, it is desirable to provide a configuration in which a diameter of a passage formed in the spring stopper 205 on the downstream side of the relief valve 202 becomes small with respect to the second hole 1*d* (vertical hole). Although the fuel released from the abnormally high pressure to the low pressure via the relief valve 200 has a large momentum, this momentum can be decreased with the above configuration. Thereby, it is possible to prevent damage of the pressure pulsation reduction mechanism 9 and the other components.

The second hole 1*d* (vertical hole) forming the relief passage 213 opens at the opening portion 213*a* to the damper chamber 10*c* housing the pressure pulsation reduction mechanism 9 that reduces low-pressure pulsation. Further, a holding member 9*a* configured to fix and hold the pressure pulsation reduction mechanism 9 is arranged between the opening portion 213*a* and the pressure pulsation reduction mechanism 9. The abnormally high-pressure fuel is released through the relief passage 213. At that time, the fuel released from the opening portion 213*a* flows into the low-pressure passage 10*c* at high speed and collides with the holding member 9*a*. As a result, when the abnormally high-pressure fuel is released to the low pressure, it is possible to avoid the problem that the pressure pulsation reduction mechanism 9 is damaged by the high speed.

Incidentally, an elastic portion 9*b*, which biases the planar portion flush with the opening portion 213*a* of the pump body 1 to bias the pressure pulsation reduction mechanism 9 toward the damper cover 14, is formed in the holding member 9*a*. More specifically, the holding member 9*a* is formed by pressing a single metal plate, and at this time, the elastic portion is formed by cutting and raising a part of a bottom portion of the holding member 9*a* toward the planar portion on the side of the opening portion 213*a* of the pump body. Further, when the damper cover 14 is attached to the pump body 1, the convex portion of the damper cover 14 biases the pressure pulsation reduction mechanism 9 toward the pump body 1, and as a result, the cut-and-raised portion 9*b* of the holding member 9*a* biases the planar portion of the pump body 1. The cut-and-raised portion 9*b* of the holding member 9*a* biases a portion other than the opening portion 213*a* as the pump body 1 is viewed from above. As a result, since it is possible to reliably bring the cut-and-raised portion 9*b* of the holding member 9*a* and the pump body 1 into contact with each other, the pressure pulsation reduction mechanism 9 can be stably supported.

REFERENCE SIGNS LIST

1 pump body
2 plunger
6 cylinder
7 seal holder
8 discharge valve mechanism
9 pressure pulsation reduction mechanism
10*a* low-pressure fuel intake port
11 pressurizing chamber
12 fuel discharge port
13 plunger seal
30 intake valve
40 rod biasing spring
43 electromagnetic coil
100 pressure pulsation propagation prevention mechanism
101 valve seat
102 valve
103 spring
104 spring stopper
200 relief valve
201 relief body
202 valve holder
203 relief spring
204 spring stopper
300 electromagnetic intake valve mechanism

The invention claimed is:

1. A high-pressure fuel supply pump comprising:
an intake valve that has a flat side surface;
a rod that collides with the flat side surface of the intake valve and biases the intake valve in a valve-opening direction;
a movable portion that is held on the rod for sliding movement on and relative to the rod, the movable portion is moveable relative to the rod to engage with a portion of the rod;
a seat member that has a plane parallel to the flat side surface of the intake valve, and has an intake valve seat on which the flat side surface of the intake valve is seated, on the parallel plane;
a first biasing spring arranged to bias the movable portion toward the portion of the rod; and
a second biasing spring that biases the rod toward the flat side surface of the intake valve: wherein:
the intake valve seat and a collision plane of the flat side surface of the intake valve where the rod collides with the intake valve are formed on a common plane,
the seat member is formed with a guide portion which guides the rod on a side opposite to the intake valve with respect to a contact position between the rod and the flat side surface of the intake valve,
the guide portion of the seat member has an outer periphery on which the second biasing spring is held,
the seat member has a fuel passage into which fuel from a low pressure flow path flows, the fuel passage formed to communicate in a vertical direction in the seat member, and
the guide portion which guides the rod is arranged in a position that does not overlap with the fuel passage.

2. The high-pressure fuel supply pump according to claim 1, wherein the flat side surface of the intake valve and the intake valve seat of the seat member are on a common plane.

3. The high-pressure fuel supply pump according to claim 1, wherein the flat side surface of the intake valve and a central axis of the rod are arranged to be orthogonal to each other.

4. The high-pressure fuel supply pump according to claim 1, wherein
the seat member is formed with a fuel passage into which fuel from a low-pressure flow path flows, and
the guide portion is arranged on a side opposite to the intake valve seat with respect to an opening portion of the fuel passage.

5. The high-pressure fuel supply pump according to claim 1, wherein
the seat member is formed with a fuel passage into which fuel from a low-pressure flow path flows, and
the guide portion is entirely arranged on a side opposite to the intake valve seat with respect to an opening portion of the fuel passage.

6. The high-pressure fuel supply pump according to claim 1, wherein
the seat member is formed with a fuel passage into which fuel from a low-pressure flow path flows, and
the intake valve seat is arranged on a pressurizing chamber side with respect to an opening portion of the fuel passage.

7. The high-pressure fuel supply pump according to claim 1, wherein
the seat member is formed with a fuel passage into which fuel from a low-pressure flow path flows, and
the entire intake valve seat is arranged on a pressurizing chamber side with respect to an opening portion of the fuel passage.

8. The high-pressure fuel supply pump according to claim 1, wherein
the movable portion is integrally attached to the rod, and
the seat member, the guide portion, and the movable portion are arranged such that a length of the guide portion is longer than a length of an opposing surface between the rod and the movable portion in a rod central axis direction.

9. The high-pressure fuel supply pump according to claim 1, wherein the seat member, the guide portion, and the movable portion are arranged such that a length of the guide portion is longer than a length of an opposing surface between the rod and the movable portion in a rod central axis direction in a state where the rod and the movable portion are engaged with each other.

10. The high-pressure fuel supply pump according to claim 1, wherein the rod and the intake valve are configured as separate members.

11. The high-pressure fuel supply pump according to claim 1, wherein the rod and the intake valve are configured as separate members, and the rod and the seat member are configured such that a length of the guide portion in a rod central axis direction is a half of a total length of the rod or longer.

12. The high pressure fuel supply pump according to claim 1, wherein the guide portion which guides the rod is fixed relative to the opening portion of the fuel passage, to remain in the position that is offset from an axis of the fuel passage.

13. The high-pressure fuel supply pump according to claim 1, wherein:

the fuel passage formed in the seat member communicates with a hole that communicates with a pressuring chamber that is above a cylinder that forms the pressuring chamber, the fuel passage being in a position that an axis of the fuel passage does not overlap with the cylinder, the intake valve is thicker than the intake valve seat of the seat member, in an axial direction of the rod, and the guide portion is arranged along a single length section of the rod, and the rod is guided by the guide portion.

14. The high-pressure fuel supply pump according to claim 1, wherein the movable portion comprises an anchor made of magnetic material.

15. The high-pressure fuel supply pump according to claim 1, wherein the second biasing spring biases the rod in a direction opposite to a direction in which the first biasing spring is arranged to bias the movable portion.

16. The high-pressure fuel supply pump according to claim 1, wherein the moveable portion has one or more through holes configured to reduce a pressure differential across the movable portion.

* * * * *